US005358439A

United States Patent [19]

Paolo

[11] Patent Number: 5,358,439

[45] Date of Patent: Oct. 25, 1994

[54] SWIMMING FLIPPER

[75] Inventor: Ferraro Paolo, Genoa, Italy

[73] Assignee: Technisub S.p.A., Genoa, Italy

[21] Appl. No.: 91,984

[22] Filed: Jul. 16, 1993

[30] Foreign Application Priority Data

Jul. 17, 1992 [IT] Italy ..... T092A000612

[51] Int. Cl.[5] ..... A63B 31/08

[52] U.S. Cl. ..... 441/64

[58] Field of Search ..... 441/61, 64

[56] References Cited

U.S. PATENT DOCUMENTS 4,007,506 2/1977 Rasmussen ..... 441/64

4,887,985 12/1989 Garofalo ..... 441/64

FOREIGN PATENT DOCUMENTS 53069173 3/1973 Australia .

0308998 3/1989 European Pat. Off. .

0436927 7/1991 European Pat. Off. .

*Primary Examiner*—Jesus D. Sotelo

*Attorney, Agent, or Firm*—Sughrue, Mion, Zinn, Macpeak & Seas

[57] ABSTRACT

Swimming flipper (1) comprising a flexible but relatively rigid blade (3) and a relatively soft shoe (2) associated to one end of the blade. The blade (3) has an active portion (5) formed by at least two relatively rigid thermoplastic materials (5*a*, 5*b*) joined to each other and of which the second (5*b*) occupies a central area of the said active portion (5) in which the first material (5*a*) is absent. Such a central area has a width comprised between 5 and 95% of the active portion (5) of the blade (3). (FIG. 1)

10 Claims, 3 Drawing Sheets

SWIMMING FLIPPER

BACKGROUND OF THE INVENTION

The present invention is related to swimming flippers comprising a flexible but relatively rigid blade and a relatively soft shoe associated to one end of the blade, and wherein the blade has an active portion formed by two materials.

Examples of swimming flippers of this type are generally known, for instance, from U.S. Pat. No. 4,820,218 and U.S. Pat. No. 5,163,859, wherein the two materials have a stratified configuration.

More particularly, the invention is directed to a swimming flipper of the above-mentioned type in which a first of the said two materials is a thermoplastic material and a second material occupies areas wherein said active portion of the blade is devoid of the first material.

Flippers of the above-referenced type are known, for instance, from U.S. Pat. No. 3,411,165, U.S. Pat. No. 4,738,645, U.S. Pat. No. 4,887,985 and U.S. Pat. No. 4,954,112.

According to U.S. Pat. No. 3,411,165, U.S. Pat. No. 4,738,645 and U.S. Pat. No. 4,887,985 the first material defines the relatively rigid load bearing structure of the blade, and the second material is a relatively thin and supple rubberlike material, defining webs having a non-stretched and baggy configuration. The webs are longitudinally secured to the first material by means of flexible joinders and define tapered, cup shaped pockets extending along the substantially rigid structure defined by the first material, which pockets tend to transversely bow or belly both downwardly and upwardly. The transverse bowing of the webs progressively increases as they extend forward from the shoe.

According to U.S. Pat. No. 4,738,645 and U.S. Pat. No. 4,887,985 the areas of the active portion of the blade devoid of the first material are constituted by two narrow slits oriented along the longitudinal direction of the blade and placed at a short distance from the lateral edges thereof, or by at least one narrow central slit, respectively.

The two slits, or the central slit, are occupied by respective highly flexible, extensible and supple membranes, constituted by the same thermoplastic rubber material of the shoe. The membranes act like hinges so as to allow relative displacement between the central area of the active portion of the blade and the two lateral areas, and when using the flipper make the central portion of the blade dynamically deformable in opposition with the swimming stroke, so as to generate thereby a liquid flow conveying canal the concavity of which is inverted as soon as the swimming stroke is reversed.

In the case of U.S. Pat. No. 4,954,112, two longitudinal slits are also provided along the active portion of the blade, which are occupied by two rubber inserts the function of which is, according to the inventor, that of providing warping of the blade so as to enable the latter, in use, to be constantly kept parallel to the displacement direction of the swimmer, thus preventing gliding of the flipper transversely.

These known flippers have several drawbacks.

Firstly, the great elastic deformability and extensibility of the rubber elements (membranes or inserts) placed along the longitudinal slits of the blade, while allowing on one hand achieving a positive effect of longitudinal calalizing the water flow during flipper motion, on the other hand involve an excessive "hinge" deformability between the different areas of the active portion of the blade separated from one another by the slits, which negatively affects the dynamic thrust power of the blade. In practice, the central portion of the blade is always displaced with a certain delay with respect to the periphery thereof, which limits in use sudden accelerations or "sprinting". The flipper is not fatiguing, but supple and of low performance.

Moreover, the rubber or thermoplastic rubber which is employed for the membranes or inserts has several defects: besides high cost both of the material itself and of the technology which are necessary for application thereof to the thermoplastic material of the remaining portion of the blade, it has a poor aging resistance, which can be improved only by means of additives giving thereto a dark grey or black colouring. As a consequence, the possibility of obtaining on the blade chromatic effects, not only pleasant from the aesthetical point of view but even such as to improve safety in use by means of colourings adapted to facilitate sighting of a diver wearing the flippers also in unclear water or dim light, are scarce.

Further the rubber is characterized by a low coefficient of elasticity. The reduced cross-section of the membranes and of the inserts according to the above prior art contributes in a very limited way to the global moment of inertia of the blade cross-sections and, therefore, in order to manufacture flippers having a sufficient rigidity it would be necessary to increase the thickness of such membranes and inserts, with a consequent burden in terms of weight and costs.

A further inconvenience, which is common to nearly all the flippers presently known, resides in the high cost for moulding the blades, deriving from the presence therein of longitudinal stiffening ribs and/or ridges, whose thickness (normally in the range of 8–10 mm) is appreciably greater than the general thickness of the blade (normally in the order of 2–4 mm). Actually, when drawing the blade out of the mould the core material within the said ribs and/or ridges is still fluid or anyway too hot, thus obliging, in order to avoid possible material shrinkage cavities and consequent negative effects both on the dynamic behaviour when using the flipper and from the aesthetic point of view, to increase the moulding cycle time so as to ensure the necessary cooling.

SUMMARY OF THE INVENTION

The object of the present invention is to avoid the above drawbacks, and more particularly to provide a swimming flipper of the type set forth at the beginning in which the active portion of the blade is on one hand provided with different elastic characteristics, so as to increase the swimming efficiency, and on the other hand also allows obtention of particularly original and at the same time useful from the point of view of a safer use of the flipper, chromatic effects.

A further object of the invention is to shorten the moulding cycle of the flipper, reducing the time necessary for cooling thereof and thus making manufacturing more economical.

According to the invention, the above objects are achieved by virtue of the fact that the second material of the active portion of the blade is also a relatively rigid and inextensible thermoplastic material and occupies a central area of the active portion of the blade having a width comprised between 5 and 95% of the said active portion, and of the fact that the two thermoplastic materials are rigidly joined to each other by means of chemical/thermic adhesion along the edges of the said central area.

The second thermoplastic material may have conveniently a rigidity different from that of the first material, lower or higher, and/or a different colouring, and/or simply, a different, provided that of some affinity, chemical composition.

Further, to the aim of improving the chemical/thermal adhesion between the two different parts of the active portion of the blade, the first and the second materials may be provided along the edges of the said central area with mutually overlapping and/or interpenetrating zones, having conveniently a substantially even thickness.

Said zones may advantageously define stiffening longitudinal elements or ribs.

BRIEF DESCRIPTION OF THE DRAWINGS

The invention will be now disclosed in detail with reference to the accompanying drawings, provided purely by way of non-limiting example, wherein.

DETAILED DESCRIPTION OF THE INVENTION

Figure 1:
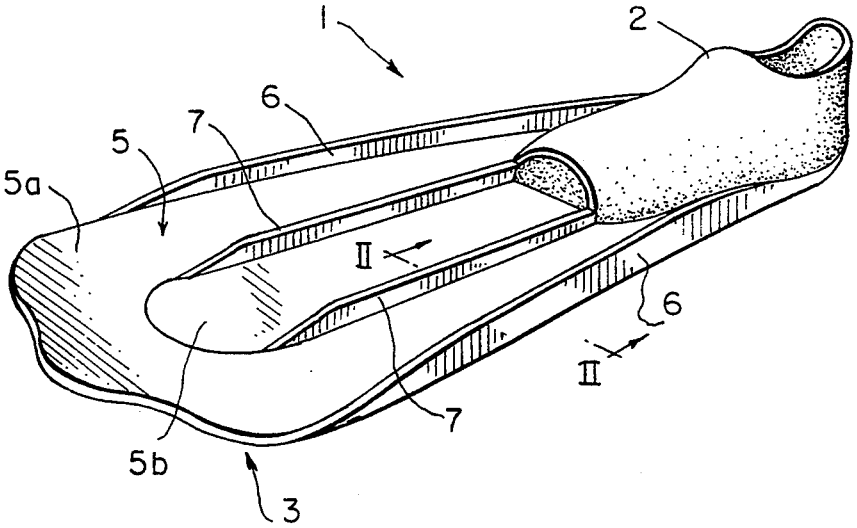
FIG. 1 is a diagrammatic perspective view showing a first embodiment of a flipper according to the invention.
Figure 2:
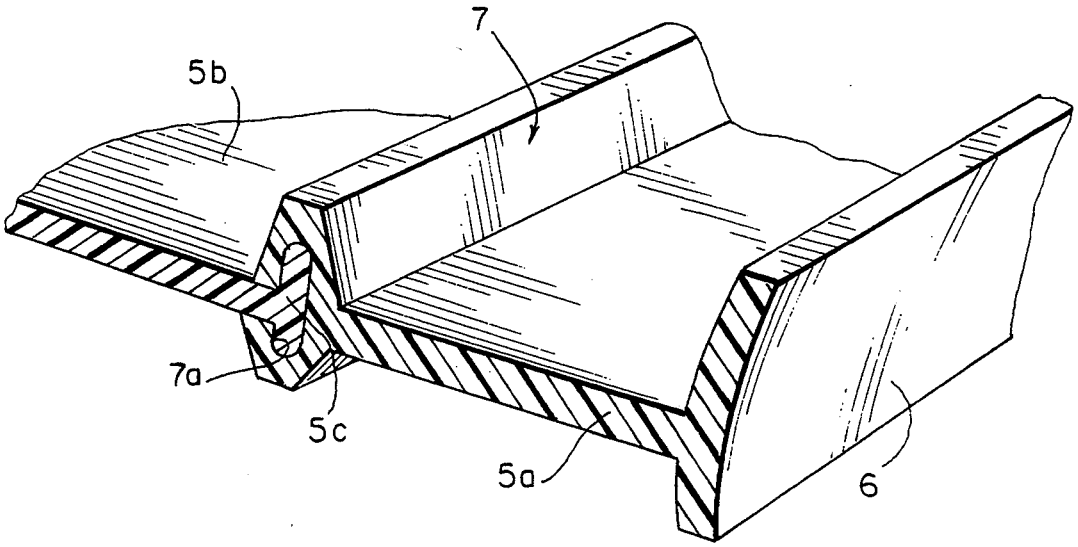
FIG. 2 is an enlarged cross-section along line II—II of FIG. 1, FIGS. 3 and 4 show two alternative embodiments of FIG. 2, FIGS. 5 and 6 show a second and a third embodiment of the flipper, respectively.
Figure 3:
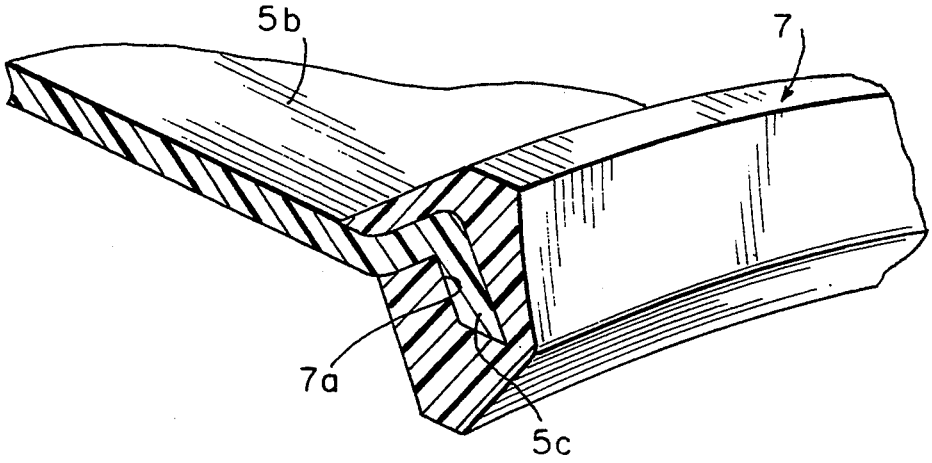
Figure 4:
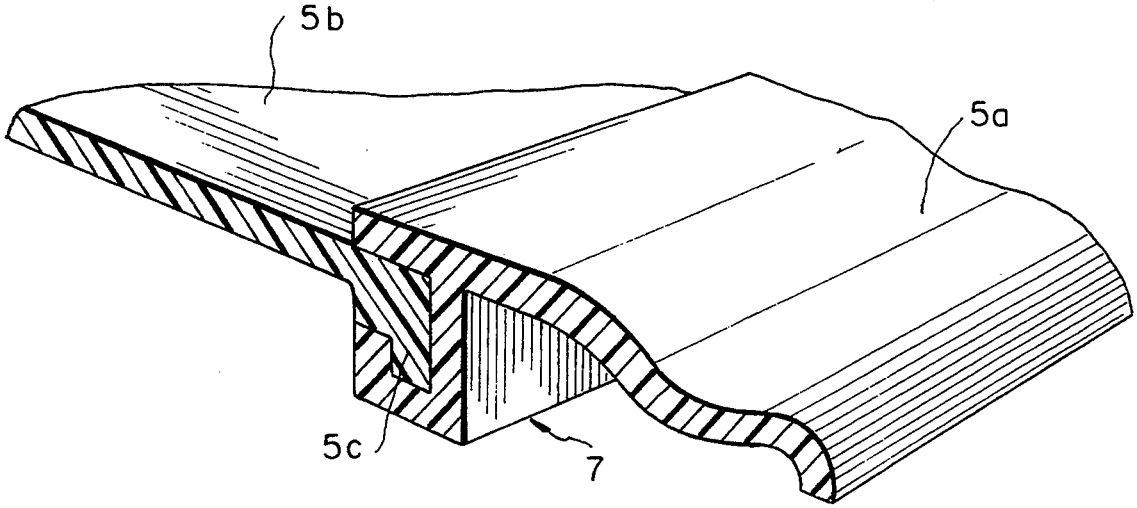

Referring initially to FIG. 1, reference numeral 1 generally designates a swimming flipper according to the invention, formed by a unitary body defining at one end thereof a shoe 2 which is followed by a blade generally indicated as 3.

The shoe 2, in the case of the shown example, is of the type having an integral rear wall: alternatively, such rear wall can be absent and replaced by an adjustable strap, of known type, such as disclosed in U.S. Pat. No. 4,820,218 and U.S. Pat. No. 5,163,859. Moreover, the shoe 2 might also be constituted by a separate element detachable from the blade 3 and adapted to be secured thereto by means of a rapid step-in system, such as shown in EP-A-93107986.7.

The shoe 2 is made of an elastomeric material or, more conveniently, a soft, resilient thermoplastic rubber. The shoe is attached, in the generally conventional manner which will be described below, to an extension 4 of the blade 3 which constitutes, at least in part, the sole of the shoe 2.

The portion of the blade 3 extending forward to the shoe 2, and which shall be designated in the following as active portion 5, has an elongated shape with two thickened lateral longitudinal elements 6 and possibly with intermediate longitudinal ribs or ridges 7.

The active portion 5 is constituted, according to the invention, by two parts, the first of which, indicated as **5*a*, defines the load bearing structure of the blade 3 and is formed with the longitudinal elements 6 and, in part, with the ribs 7, as well as with a wide central opening extending between the two ribs 7 and in which an insert 5*b* in placed. Both the portion 5*a* (except for the longitudinal elements 6 and the ribs 7) and the insert 5*b* have a sheet-like configuration and both are made of a relatively rigid thermoplastic material, but such as to ensure the necessary flexibility of use to the active portion 5. Preferably, but not necessarily, such a material can be constituted by ethylene vinyl acetate (E.V.A.), or poliurethane, or in any case a heat-weldable thermoplastic material, adapted to be easily coloured and having conveniently a melting temperature lower than that of the thermoplastic rubber of the shoe 2, to the aim of enabling, during manufacturing of the flipper 1, overmoulding on the blade 3** and consequent welding thereof by chemical-thermal adhesion.

Figure 5:
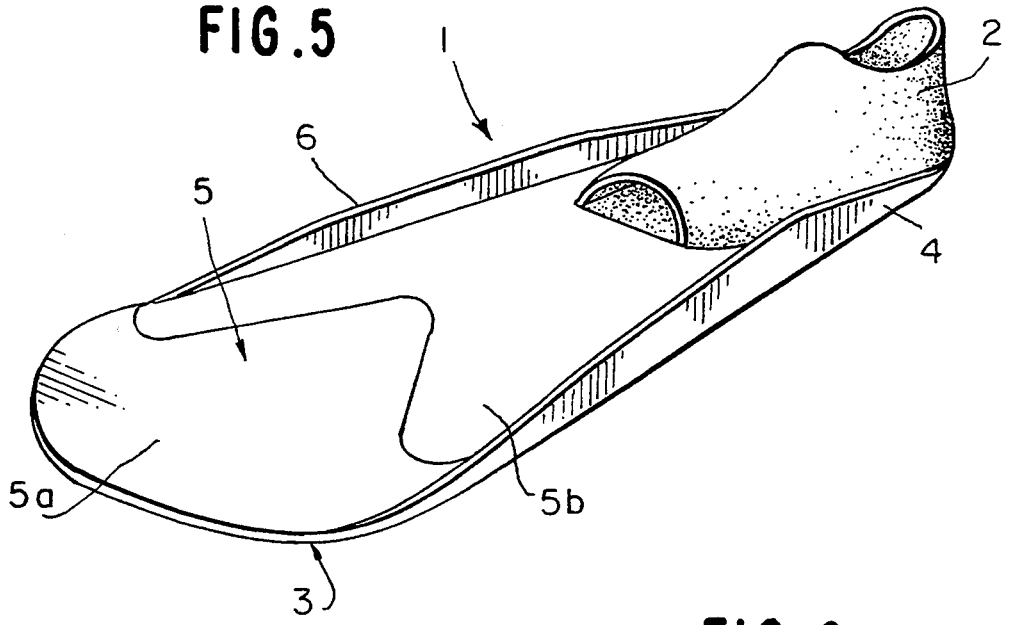
Figure 6:
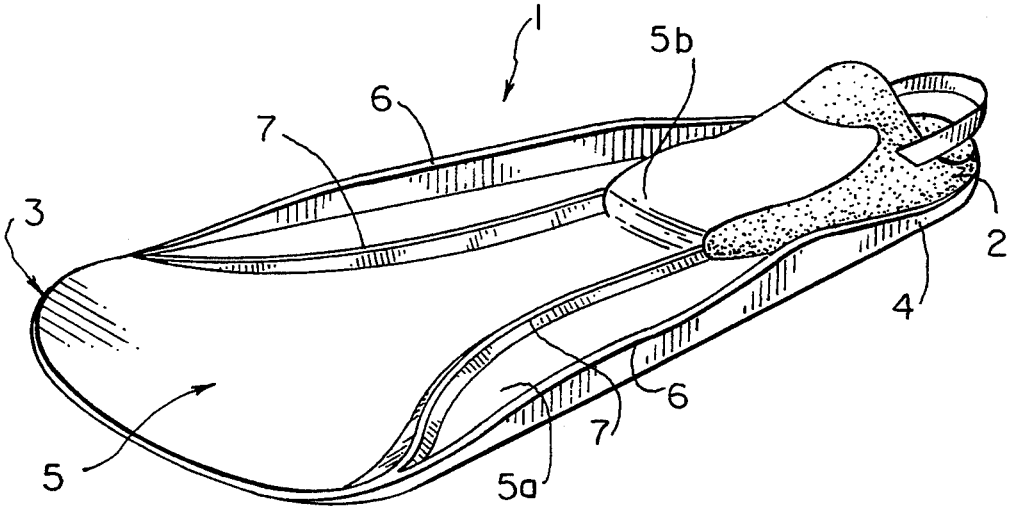
Figure 7:
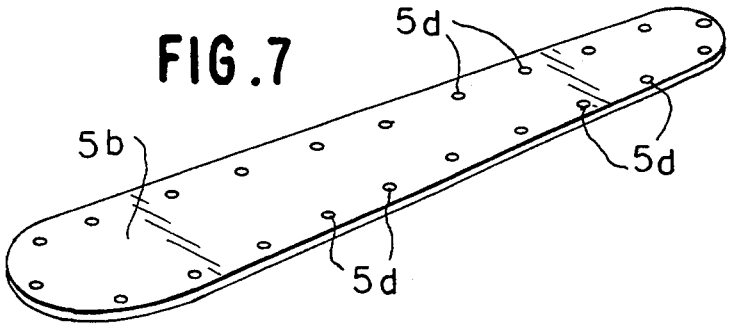
FIG. 7 shows a further alternative embodiment.

The material of the portion **5*a* and the material of the insert 5*b*, while being both relatively flexible but inextensible (i.e. non-rubber) thermoplastic materials, can differ from each other mainly to obtain in the blade differentiated characteristics of rigidity, or flexibility, and/or simply a different colouring. In order to obtain appreciable effects in either case, it is necessary that the width of the central insert 5*b* is at least comprised between 5 and 95%, for instance between 20 and 80%, of the total width of the active portion 5 of the blade 3. The insert 5*b* can extend along the whole length of the active portion 5 except for a short final section opposite to the shoe 2, as in the case of FIG. 1, or such a final section can be wider as in the example of FIG. 5, and be provided with inscriptions or wordings even imparting a contrasting chromatic effect, or still the insert 5*b* can extend along the entire active portion 5 and for instance partially overlap the shoe 2, as in the case of FIG. 6. In FIGS. 5 and 6** identical or similar parts to those previously described are indicated by the same numeral references.

According to further alternative embodiments not shown, the insert **5*b*** can be subdivided in separate elements, possibly of different materials and/or colourings, or it can be provided with lateral branches or ramifications for aesthetical and/or functional purposes.

In case the thermoplastic materials of the portion **5*a* and of the insert 5*b*** differ from each other as far the chromatic appearance is concerned, one, the other or both may have brilliant or fluorescent, bright or mat, colourings, and one of them may also be colourless and/or transparent.

As far as manufacturing of the flipper according to the invention is concerned, the forming process may be conveniently as follows.

Firstly the blade 3 is made by injection moulding, only with the material of the portion **5*a*, which is obviouly absent in the central area which is intended to be subsequently occupied by the insert 5*b***. Then the shoe is overmoulded according to the conventional technique disclosed above.

The insert **5*b* is subsequently applied into the free area of the first thermoplastic material either by forming separately such insert within a suitable mould and subsequently positioning the insert 5*b* thus formed into the mould of the first thermoplastic material, or overmoulding such insert 5*b* onto the portion 5*a* already previously formed, or still by means of a multi-injection technique, by injecting in succession the first and the second thermoplastic materials 5*a*, 5*b*** (or viceversa) into the same mould, which shall be provided with suitable known devices for delimiting the cavities to be filled by the first and, respectively, by the second thermoplastic material.

Alternatively, the connection between the two thermoplastic materials 5a, 5b, formed such as previously explained, may be obtained simultaneously with the formation of the shoe 2. The joining portions between the two materials 5a, 5b may also be covered and bonded with or thermoplastic rubber material of the shoe 2.

In any case the insert 5b will be permanently and rigidly bonded, along the edges thereof, onto the part 5a of the active portion 5 by chemical-thermal adhesion.

To the aim of further improving mutual rigid joining, the portion 5a and the insert 5b can be provided with parts of mutual overlapping and/or interpenetration, such as shown in FIGS. 2–4 and 7, respectively.

In the first case at least the longitudinal edges of the insert 5b can have (FIG. 2) a substantially T-shaped cross-section 5c, incorporated within the longitudinal ribs 7 of the portion 5a, which to such effect are formed with complementary cavities 7a. The cross-section profiles of the edges of the insert 5b and of the corresponding cavities 7a can be formed with different shapes, such as shown for instance in FIGS. 3 and 4. Practically, the ribs 7 are thus composed by the two different materials, preferably having a substantially even thickness, which allows a reduction of the cooling time following moulding of the blade 3.

In the second case, the insert 5b is formed along the edges thereof with through openings 5d adapted to be occupied by the material of the portion 5a.

It will be apparent from the foregoing that the flipper according to the invention can be formed according to simple and particularly cheap moulding techniques, by virtue of the reduced thickness of the blade 3, as well as of the double-layered constant thickness configuration of the longitudinal ribs 7, and of the consequently shortened cooling time. From the structural point of view, the possible differentiated flexibility of the two materials constituting the portion 5a and the insert 5b enables imparting the best dynamic performace to the active portion 5 of the blade 3, also with the possibility of obtaining a "canal" transverse bending so as to guide longitudinally, in use, the water flow. This is obtained without the need of employing elastomeric materials, thus avoiding drawbacks thereof (limited ageing resistance, poor chromatic variations, costly material and moulding methods thereof).

Lastly, it is to be pointed out that the flipper may be formed along the longitudinal edges thereof with arcuate stiffening end portions defining in the central area of the blade 3 a channel-like configuration. If the thermoplastic material 5b is less rigid than the material 5a, such central area shall have a single-channel configuration with a slight concavity facing upwardly, while if the thermoplastic material 5b is more rigid than the material 5a such central area shall have a double-channel, centrally slightly convex configuration.

What I claim is:

1. Swimming flipper comprising a flexible but relatively rigid blade and a relatively soft shoe associated to one end of the blade, wherein the blade, in an undeformed condition, has a substantially planar active portion formed by at least two materials of which the first is a relatively rigid and inextensible thermoplastic material and the second occupies areas wherein said active portion of the blade is devoid of the first material, wherein the second material is also a relatively rigid and inextensible thermoplastic material and occupies a central area of the active portion of the blade having a width comprised between 5 and 95% of said active portion, and wherein the two thermoplastic materials are rigidly joined to each other by chemical-thermal adhesion along the edges of said area.

2. Flipper according to claim 1, wherein the second thermoplastic material has a different rigidity than that of the first thermoplastic material.

3. Flipper according to claim 1, wherein the second thermoplastic material has a different colouring than that of the first thermoplastic material.

4. Flipper according to claim 1, wherein said first and second thermoplastic materials define mutually overlapping zones along the edges of said central area.

5. Flipper according to claim 4, wherein said zones define longitudinal stiffening elements or ribs of the blade in which said first and second thermoplastic materials have a substantially even thickness.

6. Flipper according to claim 1, wherein said first and second thermoplastic materials define mutually interpenetrating zones along the edges of the said central area.

7. Flipper according to claim 6, wherein said zones define longitudinal stiffening elements or ribs of the blade in which said first and second thermoplastic materials have a substantially even thickness.

8. Flipper according to claim 1, wherein said active portion of the blade is made by injection moulding techniques.

9. Flipper according to claim 1, wherein said active portion of the blade is made by multi-injection techniques.

10. Flipper according to claim 1, wherein said first and second materials are both ethilene-vinyl-acetate.

* * * * *